US008079482B2

(12) United States Patent
Pfenniger et al.

(10) Patent No.: US 8,079,482 B2
(45) Date of Patent: Dec. 20, 2011

(54) TEAT UNIT

(75) Inventors: Erich Pfenniger, Ebikon (CH); Peter Vischer, Küssnacht am Rigi (CH); Mario Rigert, Buchrain (CH)

(73) Assignee: Medela Holding AG, Baar (CH)

( * ) Notice: Subject to any disclaimer, the term of this patent is extended or adjusted under 35 U.S.C. 154(b) by 344 days.

(21) Appl. No.: 12/482,273

(22) Filed: Jun. 10, 2009

(65) Prior Publication Data

US 2009/0314733 A1 Dec. 24, 2009

(30) Foreign Application Priority Data

Jun. 12, 2008 (CH) ..... 0897/08
Feb. 6, 2009 (CH) ..... 0175/09

(51) Int. Cl.
*A61J 9/00* (2006.01)

(52) U.S. Cl. ..... 215/11.1; 215/11.4; 215/11.5

(58) Field of Classification Search ..... 215/11.1, 215/11.4, 11.5

See application file for complete search history.

(56) References Cited

U.S. PATENT DOCUMENTS

| | | | | | |
|---|---|---|---|---|---|
| 981,072 | A * | 1/1911 | Decker | | 215/11.1 |
| 1,735,670 | A * | 11/1929 | Blumenfeld | | 215/11.1 |
| 1,902,433 | A * | 3/1933 | Brown | | 215/11.1 |
| 1,904,710 | A | 4/1933 | Barkan | | |
| 2,133,411 | A * | 10/1938 | Zohe | | 215/11.1 |
| 3,777,753 | A * | 12/1973 | Kesselring et al. | | 215/11.1 |
| 4,623,069 | A * | 11/1986 | White | | 215/11.1 |
| 6,126,679 | A * | 10/2000 | Botts | | 606/236 |
| 2003/0071006 | A1 | 4/2003 | Kolb | | |
| 2003/0160019 | A1 * | 8/2003 | Blanding | | 215/11.1 |

FOREIGN PATENT DOCUMENTS

| | | | |
|---|---|---|---|
| CA | 2650714 | A1 | 12/2007 |
| EP | 1093785 | A2 | 4/2001 |
| WO | 03/013419 | A1 | 2/2003 |
| WO | 2004/043325 | A2 | 5/2004 |
| WO | 2007/137440 | A2 | 12/2007 |
| WO | 2008/088227 | A1 | 7/2008 |

* cited by examiner

*Primary Examiner* — Tri Mai
(74) *Attorney, Agent, or Firm* — McDonnell Boehnen Hulbert & Berghoff LLP

(57) ABSTRACT

A teat for connection to a receiving unit of a drink container has a main body and, adjoining the main body and tapered relative to the main body, a mouthpiece with at least one suction opening. The teat has a first connector element for connection to the receiving unit, a second connector element for connection to the receiving unit, and a suction channel. The suction channel extends within the mouthpiece, extends and opens via a first end into the suction opening and is directed via a second end towards the main body. This second end forms the first connector element for leaktight connection to the receiving unit. The main body is designed such that it is adapted to be turned back towards the suction opening of the mouthpiece. This teat is adapted to be connected to the feeding bottle in a simple and hygienic manner and is easy to clean.

10 Claims, 4 Drawing Sheets

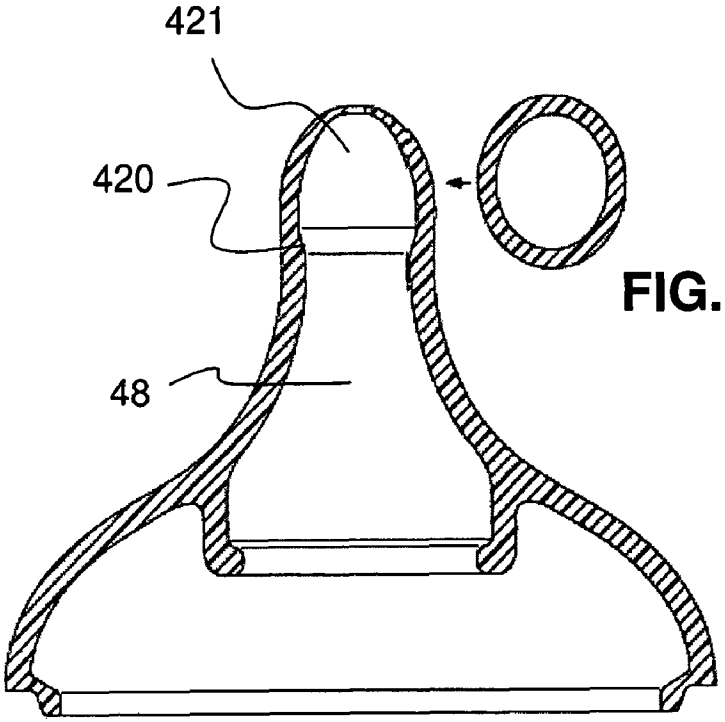
FIG. 9
FIG. 8
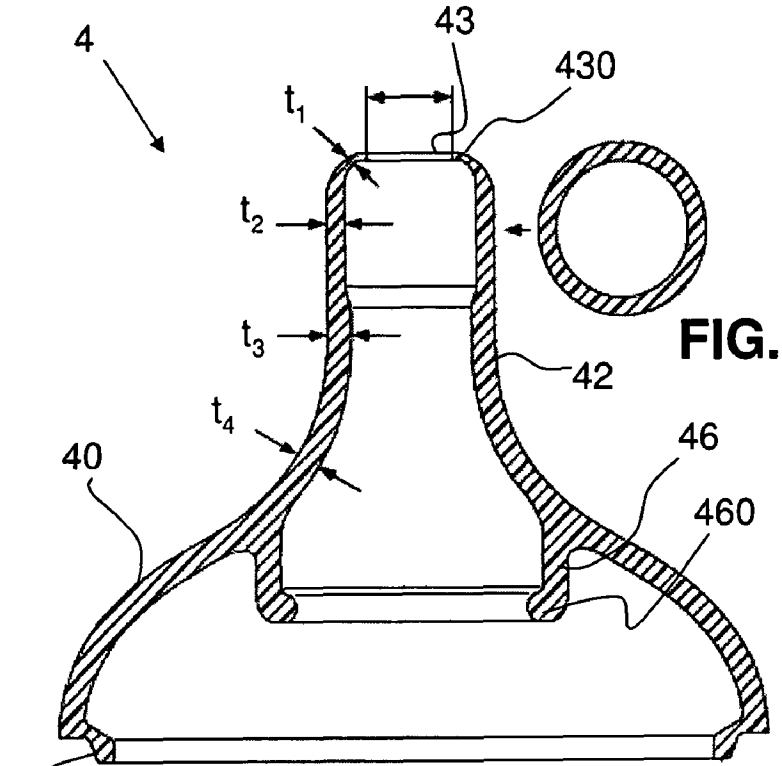
FIG. 7
FIG. 6

TEAT UNIT

CROSS-REFERENCE TO RELATED APPLICATIONS

This application claims priority to Swiss application No. 00897/08 filed on Jun. 12, 2008 and to Swiss application No. 00175/09 filed on Feb. 6, 2009.

BACKGROUND OF THE INVENTION

The invention relates to a teat unit.

A wide variety of teats for feeding bottles are known in the prior art. They are secured on a neck of the feeding bottle, usually by hand, by means of a connecting or receiving unit, for example a rotary ring. A known teat has a radially outwardly protruding flange. It is held by the mouthpiece and drawn through a rotary ring until it bears with its flange on an inner surface of the rotary ring. The rotary ring is then screwed onto the neck of the feeding bottle. Although this teat is extremely easy to fit in place, a disadvantage is that the mouthpiece has to be held in the hand and could in this way become contaminated.

U.S. Pat. No. 7,320,678 discloses a teat with a radially outwardly protruding flange, and with a cylindrical suction tube which extends within the mouthpiece and protrudes into the main body of the teat and through which the milk is sucked from the bottle to the suction opening of the mouthpiece. This suction tube has to be plugged into a corresponding receiving tube in the receiving unit. This is quite difficult to do. Moreover, this teat cannot be easily cleaned.

SUMMARY OF THE INVENTION

It is therefore an object of the invention to create a teat unit of the aforementioned type which can be fitted as easily as possible onto the feeding bottle and which, despite a possibly complex structure, can be easily cleaned. This object is achieved by a teat unit as set out herein.

The teat according to the invention for connection to a receiving unit of a drink container has a main body and, adjoining the main body and tapered relative to the main body, a mouthpiece with at least one suction opening, through which liquid emerges from the teat, and with a free end. The teat has a first connector element for connection to the receiving unit, a second connector element for connection to the receiving unit, and a suction channel. The suction channel extends within the mouthpiece, opens via a first end into the suction opening and is directed via a second end towards the main body. This second end forms the first connector element for leaktight connection to the receiving unit. According to an aspect of the invention, the main body is designed such that it can be turned back towards the free end of the mouthpiece, preferably for the purpose of connecting the first connector element to the receiving unit.

The suction opening is preferably located in the free end of the mouthpiece, i.e. in its front tip, and is in the form of a single hole. The suction opening in the front area of the mouthpiece can also be arranged laterally instead of in the tip. In both variants, it can also be formed by several holes.

Since the main body can be turned back and the first connector element is thus made easily accessible, especially being free, it can therefore be connected more easily to the receiving unit.

The main body can preferably be turned back from an intended position of use, which forms a first stable position, to the turned-back state, which turned-back state forms a second stable position.

A further advantage is that the turned-back teat can be better cleaned, since any complex structures in the interior of the main body, for example the first connector element, lie free and can be better accessed for cleaning.

In a preferred embodiment, the main body has a substantially frustoconical, spherical cap-shaped or hemispherical design. It preferably has a radially inwardly protruding flange.

In a preferred embodiment, in the turned-back state of the main body, surfaces are exposed which can be touched and which, during the intended use of the teat, do not come into contact with a liquid flowing through the teat, wherein the teat can be correctly connected to the receiving unit simply by holding it via these surfaces. The teat is preferably adapted to be connected to or mounted on the receiving unit without the use of additional aids or tools.

This is a further advantage, because the teat can be gripped only at parts which subsequently, during its intended use, do not enter the baby's mouth and are not in contact with the milk or the drinking liquid. It is thus possible to ensure that the teat can also be fitted in place under high standards of hygiene. This is very important, especially in premature babies and neonates.

The turned-back main body can be gripped via its inner face, and the mouthpiece does not have to be touched at any time. If a tubular suction channel is present in the interior of the main body, then the inner surface of the main body also does not come into contact with the drinking liquid.

In a preferred embodiment, the teat therefore has a suction channel which extends within the mouthpiece, opens via a first end into the suction opening and is directed via a second end towards the main body. This second end forms the first connector element for leaktight connection to the receiving unit. This second end preferably does not protrude beyond the main body in the position of use. By contrast, in its turned-back state, the first connector element protrudes at least partially or even completely beyond it. The suction channel preferably has a hollow cylindrical shape in the area of the second end, where it can have, for example, a radially outwardly or radially inwardly protruding flange.

In a preferred embodiment, the teat has a one-wall mouthpiece onto which is integrally formed an axially inwardly protruding skirt that extends into the main body.

In another preferred embodiment, the teat has a double-walled mouthpiece comprising an outer wall and an inner wall and with a flange formed integrally on the lower end of the inner wall. The inner wall is completely closed about its circumference and forms the suction channel through which the liquid flows. The inner wall has a flange at its free end and forms a leaktight connection.

Further advantages, objectives and embodiments are set forth in the detailed description below.

BRIEF DESCRIPTION OF THE SEVERAL VIEWS OF THE DRAWINGS

The subject matter of the invention is explained below on the basis of a preferred illustrative embodiment, which is depicted in the attached drawings. Identical parts are provided with the same reference signs. In the drawings:

FIG. 6 shows a longitudinal section through the teat according to FIG. 4 when not in use;

FIG. 7 shows a cross section, perpendicular to the longitudinal axis of the teat, through an upper area of the teat according to FIG. 6;

FIG. 8 shows a longitudinal section through the teat according to FIG. 4 during its intended use;

FIG. 9 shows a cross section, perpendicular to the longitudinal axis of the teat, through an upper area of the teat according to FIG. 8.

DETAILED DESCRIPTION OF THE INVENTION

A preferred illustrative embodiment of the teat unit according to the invention is depicted in FIGS. 1 to 10.

Figure 1:
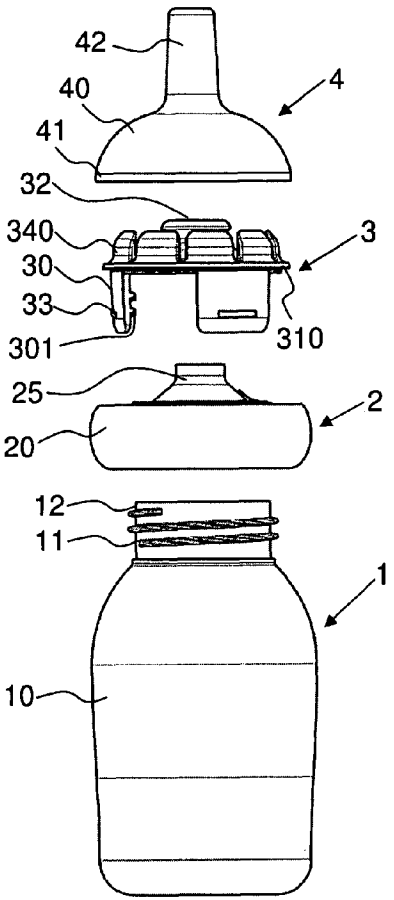
FIG. 1 shows an exploded view of a feeding bottle with a receiving unit and with a teat according to the invention in a first embodiment.

FIG. 1 shows a liquid container, here a baby's feeding bottle 1, with a neck 11 that has an outer thread 12. A teat 4 is adapted to be secured on the baby's feeding bottle 1 by means of an assembly unit or receiving unit 2, 3.

The receiving unit 2, 3 is composed principally of two parts: a base part 2 and a receiving head 3. The base part 2 is preferably made of polypropylene (PP) or a polyamide, while the receiving head 3 is made of a combination of PP or a polyamide with silicone, rubber or TPE. For the teat 4, silicone, a silicone-based plastic, rubber or TPE is preferably used.

The base part 2 is dimensionally stable (substantially rigid). It is composed principally of an annular body 20 and of a truncated cone 25 formed integrally on the latter. Centrally in the truncated cone 25, there is a through-opening or discharge opening 24 which serves as the inlet opening of the unit and which connects the interior of the container 1 to the outside, i.e. to the teat. The truncated cone 25 protrudes above the annular body 20 and extends upwards towards the receiving head 3. The discharge opening 24 is preferably arranged in the uppermost area, preferably in the flattened tip.

This base part 2 is adapted to be fitted onto the container neck 11, but without already being positionally fixed relative to the latter, in particular secured against rotation. A lower abutment is present which limits how far the container neck 11 can pass through the base part 2, i.e. how far the base part 2 can slip down on the container neck 11. For example, the abutment can be an inner contact surface in the upper area of the base ring 2. Other types of abutments are also possible, for example projecting lugs or ribs.

The receiving head 3 is also annular and preferably rotationally symmetrical. The receiving head 3 is composed principally of two areas. The lower and preferably hard area is formed here by several plug elements 30 which form sections of a common jacket that are distributed uniformly about the circumference. The plug elements 30 form a common inner thread 301 on their inner face. Instead of an inner thread, an outer thread can also be present if the drink (liquid) container 1 is provided with a corresponding inner thread.

The plug elements 30 can be plugged into slits 21 of the base part 2. Locking ribs 33 on the base part and on the receiving head 3 prevent the receiving head 3 from falling out of the base part 2.

The upper area of the receiving head 3 can be made of the same material as the lower area, or of a softer material. It can be of any desired configuration in the peripheral area. It preferably has peripheral supporting bodies or supporting structures, here supporting wings 340, which interact with the suction body or teat 4 described below.

Figure 5:
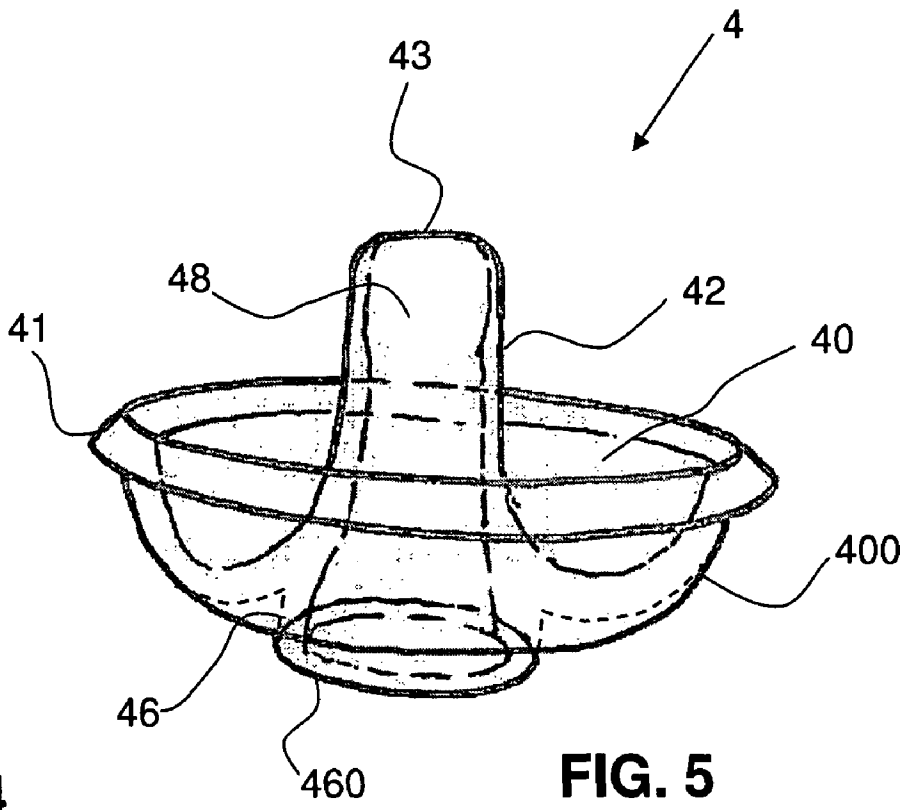
FIG. 5 shows the teat according to FIG. 4 in the turned-back state.
Figure 4:
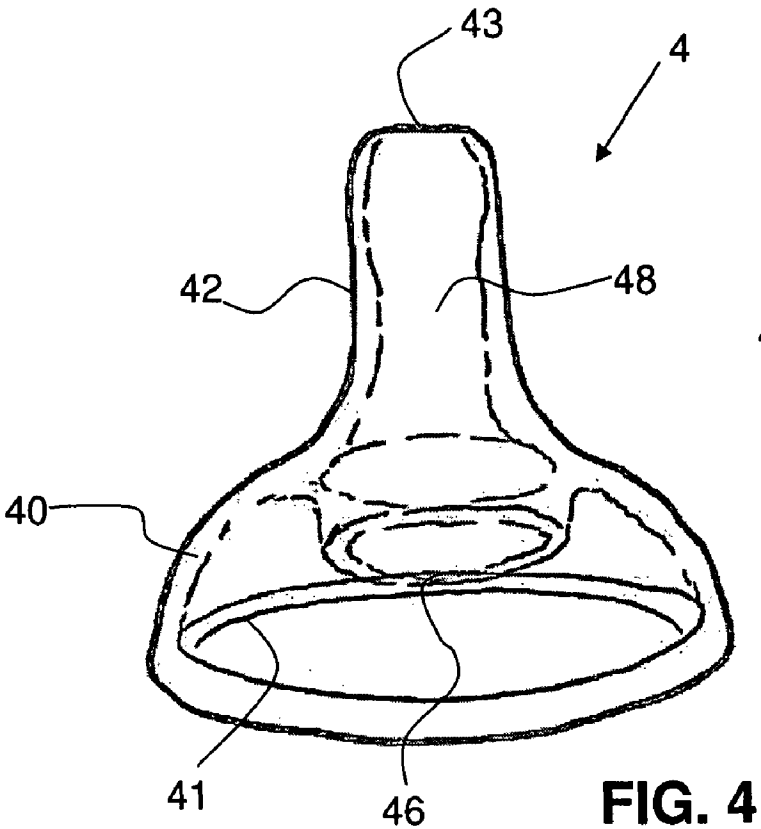
FIG. 4 shows a perspective view of the teat according to FIG. 1 in the intended position of use.
Figure 10:
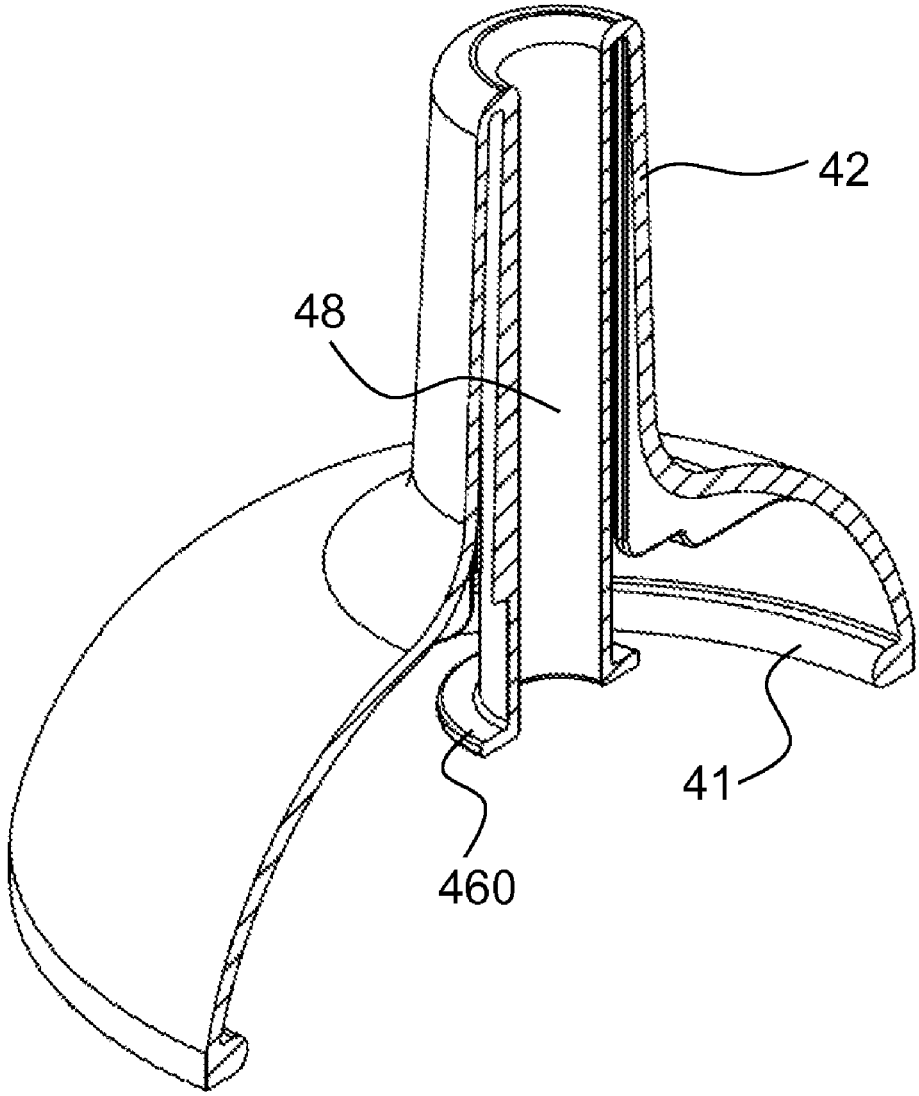
FIG. 10 shows a longitudinal section of an alternative embodiment of the teat of the present invention.

The teat 4 can be seen clearly in FIGS. 4 to 6. It has a frustoconical, spherical cap-shaped or semicircular main body 40, and a mouthpiece 42 integrally formed thereon. In its outer circumference, the mouthpiece 42 is tapered relative to the main body 40, or the latter is widened in its outer circumference relative to the mouthpiece. The main body 40 is preferably bent inwards with its lower edge, resulting in a radially inwardly directed flange 41. This flange 41 is oriented at a downward angle from the opening of the main body 40. The flange 41 is preferably made relatively narrow and stiffens the lower area of the main body 40 only very slightly, if at all.

The mouthpiece 42 is preferably designed in a known manner as a hollow cylinder or as a truncated cone. It preferably forms a thin-walled hollow body with a suction opening 43. It is resiliently and/or flexibly deformable. The suction opening 43 is present in the mouthpiece 42, preferably in the uppermost tip. During use, the liquid sucked from the container 1 emerges through this suction opening 43.

A tubular suction channel 48, also called the liquid channel or milk channel, extends in the mouthpiece 42. The suction channel 48 opens at one end into the suction opening 43. At its second end, it protrudes into the main body 40 and forms the inlet opening of the teat 4.

In this example, the mouthpiece 42 forms the upper area of the suction channel 48. The lower area of the suction channel 48 is formed by a circumferential skirt 46, which forms an extension of the mouthpiece 42 protruding into the main body 40. This skirt 46 protrudes towards the receiving head 3. An inwardly or outwardly protruding flange 460 is preferably formed integrally on the skirt 46.

The suction opening 43 or the suction channel 48 preferably has a round cross section in the upper area, as can be seen in FIG. 7. Since the mouthpiece 42 is relatively soft, it is deformed during its intended use, and the suction opening 43 or the suction channel 48 in the adjacent area can assume an oval shape, for example, as is shown in FIG. 9.

The mouthpiece 42 can be of any desired shape, provided that it remains flexible and resilient. As can be seen in particular from FIGS. 6 and 8, the wall of the mouthpiece 42 can increase in thickness towards the head part 3. This increase takes place in stages here. Typical wall thicknesses are: t1 circa 0.5 mm, t2 circa 1.5 mm, t3 and t4 circa 2.0 mm. Other sizes are possible, however. In the mouthpiece 42, there is preferably a tapered area 420 in the internal diameter, such that a deforming hollow space 421 is formed in the area of the suction opening 43. The hollow space 421 is arranged adjacent to the tapered area 420. This hollow space 421, like the suction opening 43 also, preferably has a substantially round cross section. The cross section of this hollow space 421 deforms during the intended use of the teat. The hollow space 421 can in particular become longer, but narrower, and change from a round cross section to an oval cross section. This shape may be changed during feeding by the baby.

The mouthpiece is preferably flexible and, during its intended use, there are preferably no parts protruding into and stiffening the mouthpiece along a substantial part of its length. The mouthpiece is therefore preferably deformable during its intended use.

Other embodiments are possible. Thus, for example, the suction channel 48 can be spaced apart from an inner wall of the mouthpiece and designed as an independent tube. In this example, however, the suction channel 48 is formed in one piece with the mouthpiece 42 and is preferably made of the same material. The whole teat 4 is preferably made in one piece.

In the assembled state, the suction opening 43 is connected to the interior of the container 1 via this suction channel 48 and, subsequently, via the through-opening 32 and the discharge opening 24, such that the baby is able to take its drink, e.g. tea, water or milk, through this opening.

Figure 3:
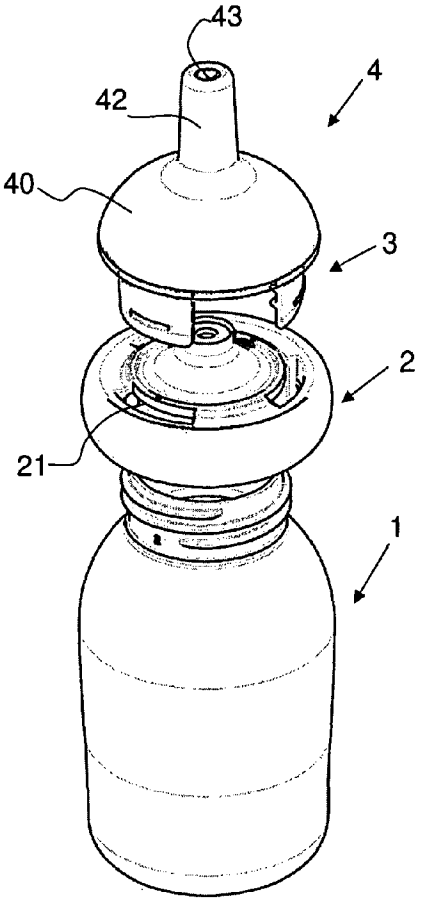
FIG. 3 shows the teat according to FIG. 1 secured on a part of the receiving unit.
Figure 2:
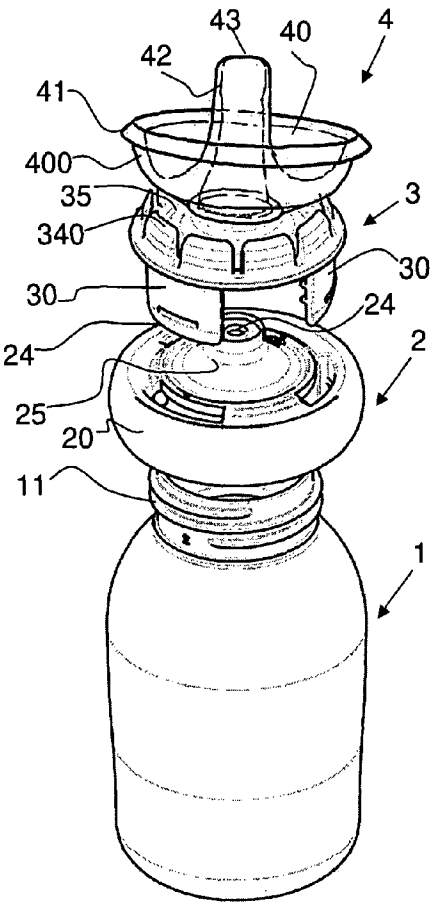
FIG. 2 shows the feeding bottle, receiving unit and teat according to FIG. 1, with a teat that has been turned back in order to be fitted.

As can be seen from FIG. 2, the teat 4 can be pushed with its main body 40 over the receiving head 3. According to the invention, the main body 40 is inverted in this process until it has adopted its second stable position. This inverting can be done by hand, by gripping the lower edge of the main body 40 and bending it upwards and outwards. The main body 40 thus assumes its second stable position, as is shown in FIG. 5. As can be seen clearly from FIG. 5, in this stable inverted position, the first connecting means or securing means, namely the lower end of the suction channel 48 lies free and protrudes from the inverted main body 40. The teat 4 can be held via the now outwardly protruding inner face 400 of the main body 40, and the free end of the suction channel 48, here the skirt 46, can be pushed over the truncated cone 35 and thus over the through-opening 32 of the receiving head 3. The flange 460 of the skirt 46 engages behind a bead or a rib of the truncated cone 35 and rests sealingly thereon. Since the skirt 46 is easy to see and easily accessible, this can be done is a simple manner.

The main body 40 is now turned back down to its stable position of use, again by means of just the free edge of the main body 40 being pulled downwards. The flange 41 of the main body 40 engages behind the protruding edge between the upper and lower areas of the receiving head 3 and rests flat and sealingly on the outer sealing face 310 of the receiving head 3. The teat 4 is now fitted on the receiving head 3 in the manner shown in FIG. 3.

The teat 4 can in this way be placed onto the receiving head 3 or partially pushed over the latter. The receiving head 3 can then be plugged into the base part 2. The receiving head 3 can be plugged into the base part 2 when the latter is free, but also when the latter is already located on the container neck 11. Since the base part 2 can still move slightly in the axial direction relative to the receiving head 3, the teat 4 can also be pushed over the receiving head 3 only after the receiving head 3 and base part 2 have been plugged together.

By rotating the base part 2 or the receiving head 3 on the container neck 11, the two threads, namely the outer thread 12 and inner thread 301, mesh with each other. The receiving head 3 runs downwards along the thread. The base part is pulled down with it as far as its lower abutment. The base part 2 and the receiving head 3 are now secured on the container 1 and secured against rotation relative to each other. In this way, the outer sealing face 270 of the base part 2 is now pressed relative to the outer sealing face 310 of the receiving head 3. They clamp the flange 41 of the teat 4 and thus ensure a liquid-tight and air-tight connection between teat 4, receiving head 3 and base part 2. Depending on the particular design, a differently shaped lower edge 41 of the teat 4 can also be clamped sealingly between the two parts 2, 3.

As has been described above, the teat, despite its relatively complicated internal structure (as compared to a simple common nipple structure), can be easily fitted in place in this way. As can be seen from FIG. 5, it can also be well cleaned, since all areas of the teat are readily accessible.

The described mode of assembly with the two-part receiving unit is only one of many possible examples of how an inverted teat with exposed connector element can be fitted in place. Moreover, the teat does not necessarily have to be placed onto a receiving unit. For example, it can also pass through a receiving unit.

The radially inwardly directed flange of the main body can be flush with the opening plane of the main body or can be oriented downwards at an angle from the opening of the main body.

Moreover, instead of the suction channel or the skirt, a differently shaped inner connecting means can also be present. For example, a suction channel can have a radially outwardly directed flange that engages behind a correspondingly shaped seat of the receiving unit, in particular of the receiving head.

The first connector element, i.e. the free end of the suction channel, does not necessarily have to protrude into the main body. It is also possible for the suction channel to terminate at the end of the mouthpiece directed towards the main body. This free end of the suction channel is in this case shaped in such a way that it permits a leaktight, preferably plug-in connection to the receiving unit, for example by provision of suitable sealing means on or in the suction channel. In particular, this end area of the suction channel can be designed as a cone that takes up the receiving unit with pretensioning.

For example, the mouthpiece and/or the suction channel can further be provided with internal structures, for example radial or axial grooves, ribs, indentations or knobs. The suction channel can also be provided on its outside with such internal structures. The outer and inner surfaces of the main body can also have a plane or structured design.

The mouthpiece can be designed with a double wall along its entire length, in which case the two walls extend at a distance from each other, and either they join each other in the area of the mouthpiece or the inner wall ends free. The inner wall thus forms the suction channel. Ribs or other spacers protruding into the gap between the walls can be arranged on the outer wall and/or on the inner wall.

The mouthpiece and/or the suction channel can have, for example, a hollow cylindrical or frustoconical design on the inside and/or the outside. The chosen suction opening can be relatively large or small. The suction opening can in particular have approximately the same cross-sectional surface area as the suction channel along its entire length. The suction opening can also have a smaller cross-sectional surface area than the suction channel. These variants can be combined with one another in any desired manner.

The teat according to the invention is adapted to be connected to the feeding bottle in a simple and hygienic manner and is, moreover, easy to clean.

The invention claimed is:

1. A teat unit having a teat and a receiving unit for connection of the teat to a drink container, wherein the teat comprises:

a main body, and a mouthpiece having at least one suction opening and a free end, the mouthpiece adjoining the main body and being tapered relative to the main body, wherein the teat has a first connector element for connection to the receiving unit, a second connector element for connection to the receiving unit, and a suction channel, wherein the suction channel extends within the mouthpiece, opens via a first end into the suction opening and is directed via a second end towards the main body, and wherein the second end forms the first connector element for a leaktight connection to the receiving unit, wherein the main body is adapted to be turned back towards the free end of the mouthpiece, and the receiving unit comprises a base part and a receiving head, wherein when the teat unit is connected to the drink container, the main body of the teat is placed over the receiving head and the receiving head is plugged into the base part.

2. The teat unit according to claim 1, wherein the main body is adapted to be turned back from an intended position of use, which forms a first position, to the turned-back state, which turned-back state forms a second position.

3. The teat unit according to claim 2, wherein the second end protrudes into the main body.

4. The teat unit according to claim 3, wherein the second end, in the turned-back state of the main body, at least partly protrudes from the main body.

5. The teat unit according to claim 1, wherein the suction channel has a hollow cylindrical shape, at least in the area of the second end.

6. The teat unit according to claim 1, wherein the mouthpiece is designed as a double wall comprising an outer wall and an inner wall, wherein the inner wall encloses and forms the suction channel.

7. The teat unit according to claim 1, wherein the main body has a radially inwardly protruding flange.

8. The teat unit according to claim 1, wherein, in the turned-back state of the main body, surfaces of the teat are exposed which, when connected to the drink container, do not contact a liquid flowing through the teat, and wherein the teat is adapted to be connected to the receiving unit by holding the surfaces.

9. The teat unit according to claim 8, wherein the teat is adapted to be manually connected to the receiving unit without the use of tools.

10. The teat unit according to claim 1, wherein an area of the suction channel, which is turned towards the second end, includes a circumferential skirt which forms an extension of the mouthpiece and extends into an interior of the main body, and wherein the circumferential skirt forms the second connector element.

* * * * *